US009209571B2

(12) United States Patent
Myong

(10) Patent No.: US 9,209,571 B2
(45) Date of Patent: Dec. 8, 2015

(54) CONNECTOR ASSEMBLY HAVING MULTIPLE SHIELD CURRENT PATHS

(71) Applicant: Tyco Electronics Corporation, Berwyn, PA (US)

(72) Inventor: Inho Myong, Menlo Park, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 152 days.

(21) Appl. No.: 14/055,068

(22) Filed: Oct. 16, 2013

(65) Prior Publication Data

US 2015/0104976 A1 Apr. 16, 2015

(51) Int. Cl.

| | |
|---|---|
| ***H01R 4/66*** | (2006.01) |
| ***H01R 13/648*** | (2006.01) |
| ***H01R 13/58*** | (2006.01) |
| ***H01R 13/6592*** | (2011.01) |
| *H01R 9/03* | (2006.01) |
| *H01R 13/622* | (2006.01) |

(52) U.S. Cl.

CPC ..... *H01R 13/648* (2013.01); *H01R 13/5808* (2013.01); *H01R 13/5812* (2013.01); *H01R 13/6592* (2013.01); *H01R 9/032* (2013.01); *H01R 13/5841* (2013.01); *H01R 13/622* (2013.01)

(58) Field of Classification Search

CPC ..... H01R 4/64; H01R 4/643
USPC ..... 439/92, 100, 799, 777, 83, 98, 833
See application file for complete search history.

(56) References Cited

U.S. PATENT DOCUMENTS

| | | | | |
|---|---|---|---|---|
| 6,339,193 | B1 | 1/2002 | Goett et al. | |
| 7,182,611 | B2 * | 2/2007 | Borden et al. | 439/92 |
| 7,997,923 | B1 | 8/2011 | Oh et al. | |
| 8,071,291 | B2 * | 12/2011 | Bare et al. | 435/6.11 |
| 8,435,066 | B2 | 5/2013 | Myong | |
| 8,535,085 | B1 | 9/2013 | Reilly | |
| 8,882,517 | B2 * | 11/2014 | Smith et al. | 439/92 |
| 8,899,998 | B2 * | 12/2014 | Pyron | 439/100 |
| 2005/0188501 | A1 * | 9/2005 | Borden et al. | 16/273 |
| 2008/0009173 | A1 | 1/2008 | Carnahan | |
| 2012/0258624 | A1 | 10/2012 | Oh | |
| 2014/0113488 | A1 | 4/2014 | Mehnert et al. | |

FOREIGN PATENT DOCUMENTS

DE 102011078622 A1 1/2013

OTHER PUBLICATIONS

International Search Report for International Application No. PCT/US2014/059771, mailed Jan. 8, 2015.

* cited by examiner

*Primary Examiner* — Phuongchi T Nguyen

(57) ABSTRACT

A connector assembly may include a housing that retains one or more contacts, a cable having a shield that surrounds one or more conductors that electrically connect to the one or more contacts, and a backshell that secures the housing to the cable. The backshell may include at least one wall having a backshell outer surface and a backshell inner surface, and one or more through-holes formed through the at least one wall. Each through-hole forms a current path between the backshell outer surface and the backshell inner surface.

17 Claims, 6 Drawing Sheets

CONNECTOR ASSEMBLY HAVING MULTIPLE SHIELD CURRENT PATHS

BACKGROUND OF THE DISCLOSURE

Embodiments of the present disclosure generally relate to electrical connector assemblies, and, more particularly, to electrical connector assemblies having multiple shield current paths.

A typical electrical connector includes a flexible outer braid or shield that surrounds one or more conductors. The flexible outer braid or shield secures to a connector through one or more attachment devices and/or an adapter. Electromagnetic interference on or within the conductor(s) may be generated, thereby resulting in shield current that passes from the shield to the connector. The shield current ultimately passes from the connector to ground.

In general, the outer braid or shield connects to the connector through a backshell. Shield current typically passes from the outer braid or shield to the connector by way of the backshell. In general, the shield current passes to the connector over an outer surface of the backshell. However, if conductive material on the backshell is damaged or otherwise worn (such as through abrasions, scratches, and the like), then the shield current may be impeded from passing to the connector, and ultimately to ground. As such, the path of least resistance to the connector may be between the shield and an edge of the backshell. However, the edge of the backshell is susceptible to damage and wear. If the conductive path through the edge is compromised, such as through mechanical wear and tear, the path to ground for the shield current through the backshell may be further restricted or nonexistent. As the shield current path is further restricted, resistance within the electrical connector generally increases, which reduces the overall shielding effectiveness of the electrical connector.

In general, shielding effectiveness of typical electrical connectors may be restricted when conductive material on a backshell wears or erodes, and/or when an interface edge of the backshell is worn or otherwise mechanically damaged. Accordingly, shield current may be restricted and/or prevented from passing to ground.

BRIEF DESCRIPTION OF THE DISCLOSURE

Certain embodiments of the present disclosure provide a connector assembly that may include a housing that retains one or more contacts, a cable having a shield that surrounds one or more conductors that electrically connect to the one or more contacts, and a backshell that secures the housing to the cable. The backshell may include at least one wall having a backshell outer surface and a backshell inner surface, and one or more through-holes formed through the at least one wall. Each through-hole forms a current path between the backshell outer surface and the backshell inner surface. The backshell may include a dielectric core covered with a conductive material.

Each through-hole is configured to allow shield current from the shield to pass from the backshell outer surface to the backshell inner surface. A primary current path may span between the shield and the housing via the backshell outer surface. The current path may provide a secondary current path for shield current to pass when the primary current path is restricted.

The backshell may also include a cable connecting interface configured to be covered by at least a portion of the shield. Through-holes may be formed through the cable-connecting interface.

Each through-hole may have interior surfaces covered with plating material. Alternatively, the through-holes may be plugged with plating material.

The connector assembly may also include a connecting ring that securely clamps a portion of the backshell to a portion of the housing. The connecting ring may include one or more ring through-holes. The connecting ring may include a dielectric core having at least a portion covered with a conductive material.

Certain embodiments of the present disclosure provide a backshell that is configured to secure a housing that retains one or more contacts to a cable having a shield that surrounds one or more conductors that are configured to electrically connect to the one or more contacts. The backshell may include at least one wall having a backshell outer surface and a backshell inner surface, and one or more through-holes formed through the at least one wall. Each of the one or more through-holes forms a current path between the backshell outer surface and the backshell inner surface.

Certain embodiments of the present disclosure provide a connector assembly that may include a housing that retains one or more contacts, a cable having a shield that surrounds one or more conductors that electrically connect to the one or more contacts, and a backshell that secures the housing to the cable. The backshell may include a dielectric core covered with conductive material, and at least one wall having a backshell outer surface and a backshell inner surface. A primary current path spans between the shield and the housing via the backshell outer surface. A plurality of plated through-holes are formed through the at least one wall. Each of the plurality of plated through-holes forms a secondary current path between the backshell outer surface and the backshell inner surface. The plurality of plated through-holes are configured to allow shield current from the shield to pass from the backshell outer surface to the backshell inner surface.

DETAILED DESCRIPTION OF THE DISCLOSURE

Figure 1:
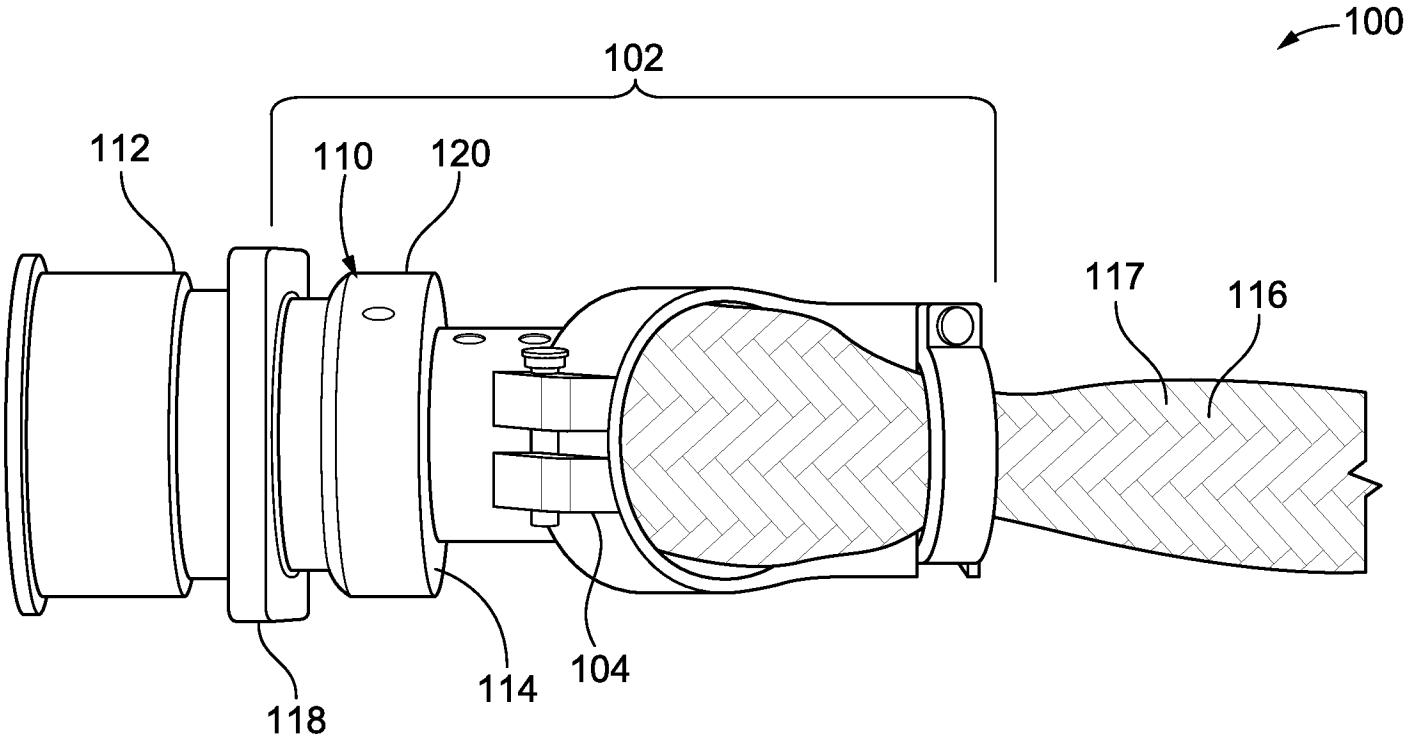
FIG. 1 illustrates a perspective view of a connector assembly, according to an embodiment of the present disclosure.

FIG. 1 illustrates a perspective view of a connector assembly 100, according to an embodiment of the present disclosure. The connector assembly connector assembly 100 may be a fixed, in-line, or articulating connector, for example. The connector assembly 100 may be configured to couple to a mating connector 104 to electrically communicate data and/or power signals.

The connector assembly 100 may include a backshell 102. The connector assembly 100 may also include a housing or hood 110 that extends from a mating end 112 to an opposite back end 114. The mating end 112 is configured to join with the mating connector 104 to electrically couple the connector assembly 100 thereto. The back end 114 may join with the backshell 102. The housing 110 may retain several contacts (not shown in FIG. 1) that are electrically coupled with conductors (not shown in FIG. 1). The conductors may extend through insulated jackets that are held in a cable 116. The cable 116 may include a braided shield 117 that encloses the insulated jackets and the conductors. The cable 116 exits the housing 110 through the back end 114 and extends through the backshell 102.

The housing 110 may form a multi-part housing that includes an engagement section 118 and a coupling section 120. The engagement section 118 includes the mating end 112 and engages the mating connector 104 to electrically connect the connector assembly 100 with the mating connector. The coupling section 120 includes the back end 114 and secures the engagement section 118 with the backshell 102. The coupling section 120 may include a coupling nut and/or adapter, for example.

The backshell 102 is generally used to secure the cable 116 to the housing 110. The backshell 102 is used to shield the wire connection points and interfaces of the cable 116 and the housing 110. The backshell 102 may be configured to provide a secure connection between a cable-clamping device and the housing 110. Alternatively, the backshell 102 may include an integrally-formed clamping device.

While not shown, the backshell 102 may be configured to articulate. Optionally, the backshell 102 may be a fixed backshell, such as a linear, 45°, 90°, or the like, type backshell. The backshell 102 shown in FIG. 1 is merely exemplary. It is to be understood that the application is not limited to the exact backshell 102 shown in FIG. 1. In general, embodiments of the present disclosure may be used with any backshell that is configured to connect a cable to a connector housing or hood.

The backshell 102 may be configured to secure to a threaded end of the coupling section 120. Alternatively, the backshell 102 may be configured to snapably secure to the coupling section 120.

Embodiments of the backshell 102 may be further described in U.S. Pat. No. 7,997,923, entitled "Cable Organizer for a Connector Assembly," and U.S. Pat. No. 8,435,066, entitled "Rotationally Configurable Backshell for an Electrical Connector," both of which are hereby incorporated by reference in their entireties.

As described below, through-holes may be formed through the backshell 102 at areas that are connected to an outer cable shield of the cable 116. In this manner, additional shield current paths are formed between an outer surface of the cable 116 and the housing 110 (and ultimately to ground). Thus, electromagnetic interference that accumulates on an outer surface of the cable 116 may flow to the backshell 102 as shield current. The shield current may pass over outer surfaces and edges of the backshell 102 that connect to the outer surface of the cable 116. Additionally, the through-holes formed through the connection interface between the outer surface of the cable 116 and the backshell 102 provide additional shield current paths for the shield current to travel. Thus, if an outer surface of the backshell 102 is damaged such that it may restrict current flow, the shield current may flow from the outer surface of the cable 116, to an on outer surface of the backshell 102, and to an inner surface of the backshell 102 through the one or more through-holes. The shield current may then pass from the inner surface of the backshell to the housing 110, and ultimately to ground.

The backshell 102 (and any of the backshells described in the present application) may be formed of a dielectric material. For example, the backshells described in the present application may include cores or bases that may be formed of polyetherimide (PEI), polyether ether ketone (PEEK), and/or various other dielectric materials. The dielectric material of the backshell 102 may be reinforced with carbon fiber, for example. In general, the dielectric material of the composite backshell 102 may be covered or coated in conductive materials, such a plating material (for example, copper, cadmium, nickel, or various other metallic materials). The plating material provides a conductive path for the shield current to pass.

Figure 2:
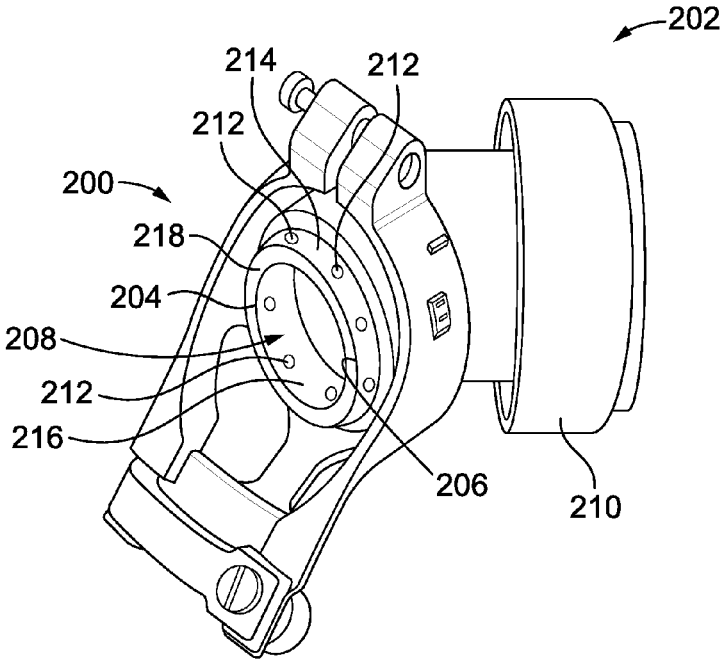
FIG. 2 illustrates a perspective view of a backshell of a connector assembly, according to an embodiment of the present disclosure.

FIG. 2 illustrates a perspective view of a backshell 200 of a connector assembly 202, according to an embodiment of the present disclosure. The backshell 200 may include cable-connecting interface 204, which may include a circumferential wall 206 that defines an interior passage 208. An end of a cable, such as the cable 116 (shown in FIG. 1), is configured to connect to the cable-connecting interface 204 around the cable-connecting interface 204 so that interior conductors, for example, pass into the interior passage 208 and connect to a housing or hood 210 of the connector assembly 202.

As shown in FIG. 2, multiple through-holes 212 are formed through the cable-connecting interface 204. Each through-hole 212 extends from an outer surface 214 of the wall 206 to an inner surface 216 that defines a proximal end of the interior passage 208. Each through-hole 212 is plated with conductive material, such as copper, cadmium, nickel, or various other metallic materials. Accordingly, a conductive path is defined between the outer surface 214 and the inner surface 216 through each through-hole 212.

In operation, shield current from an outer surface of the cable (such as the cable 116 shown in FIG. 1) may pass over the outer surface 214, and then into ground through the housing 210. Additionally, the shield current may pass from the outer surface of the cable through a proximal edge 218 of the backshell 200 and to ground through the housing 210. The through-holes 212 provide additional shield current paths for the shield current to pass, in addition to the path over the outer surface 214 of the backshell 200 and/or through the proximal edge 218. Thus, if the outer surface 214 and/or the proximal edge 218 are worn or otherwise damaged such that current flow may be restricted therethrough or over, the shield current then follows the path of least resistance and passes from the outer surface 214 of the backshell 200 to the inner surface 216 by way of the plated through-holes 212. The shield current that is generated on the cable may pass to ground through multiple shield current paths. The backshell 200 provides multiple, redundant shield current paths including the outer surface 214, the proximal edge 218, and the plated through-holes 212. If one of the shield current paths becomes damaged, the shield current may pass through the remaining shield current paths. Further, providing multiple plated through-holes 212 through the backshell 200 provides additional shield current path redundancy. For example, if the plating of one plated through-hole 212 becomes damaged, the shield current is still able to flow through the other plated through-holes 212.

The backshell 200 may include more or less through-holes 212 formed through the circumferential wall than shown in FIG. 2. Additionally, the through-holes 212 may be formed at various other areas of the backshell 200. For example, through-holes 212 may be formed at areas of the backshell 200 that do not directly abut or connect to any portion of the cable. In at least one embodiment, plated through-holes may be formed within a portion of the backshell 200 that directly connects to the housing 210. Such through-holes may be in addition to, or in place of, the through-holes 212 formed through the cable-connecting interface 204, as shown in FIG. 2.

Figure 3:
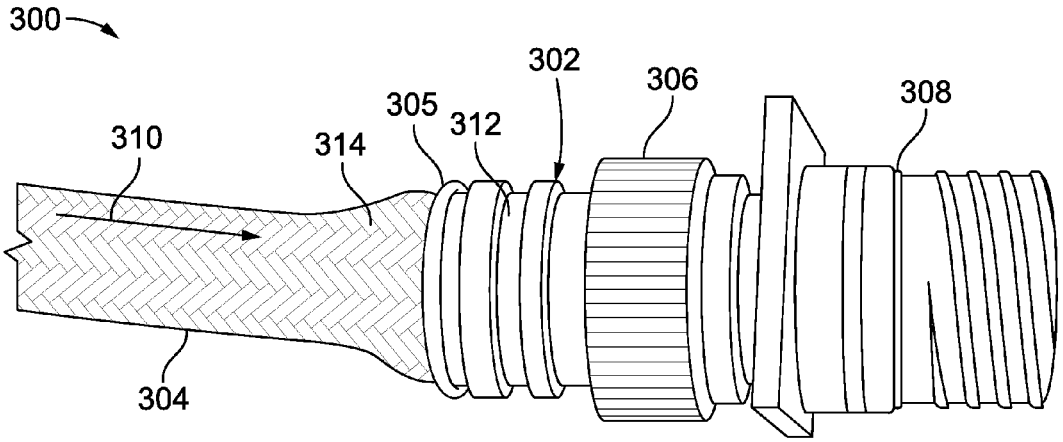
FIG. 3 illustrates a perspective view of a connector assembly, according to an embodiment of the present disclosure.

FIG. 3 illustrates a perspective view of a connector assembly 300, according to an embodiment of the present disclosure. The connector assembly 300 is similar to the connector assemblies described in FIGS. 1 and 2. A backshell 302 may be fixed and linear.

The connector assembly 300 includes a cable 304 that connects to the backshell 302 through a connection member 305, such as a clamping ring. A rotatable adapter or connecting nut 306 may be used to securely connect a threaded end of the backshell 302 to an end of a housing or hood 308. As explained above, shield current 310 may pass over the cable 304 and onto an outer surface 312 of the backshell 302. The shield current 310 may then pass over the outer surface 312 and onto an outer surface of the housing 308, before ultimately passing to ground. Additionally, plated through-holes (shown in FIG. 2) may be formed through the cable-connecting interface of the backshell 302 underneath an end of an outer surface 314 of the cable 304, thereby providing an additional redundant path for the shield current to pass into the housing 308, and ultimately to ground.

Figure 4:
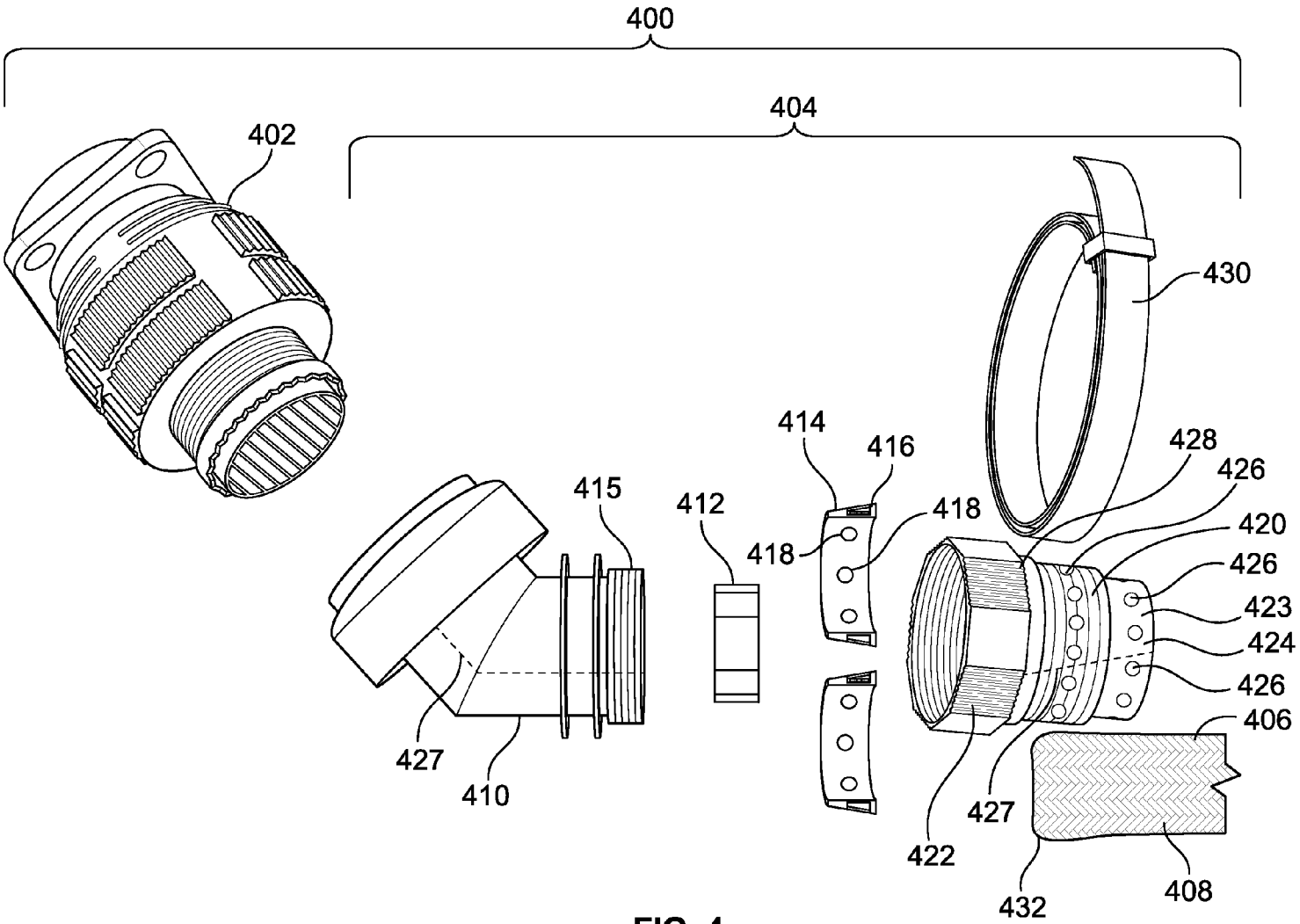
FIG. 4 illustrates a perspective view of a connector assembly in a disassembled state, according to an embodiment of the present disclosure.

FIG. 4 illustrates a perspective view of a connector assembly 400 in a disassembled state, according to an embodiment of the present disclosure. The connector assembly 400 includes a housing or hood 402 that connects to a backshell 404, which, in turn, connects to a cable 406, which may include a braided shield 408. The backshell 404 may include a connecting body 410 that is configured to connect electrical conductors contained within the braided shield 408 to the housing 402 at an angled connection, such as a 45° angle. Alternatively, the connecting body 410 may be a straight, linear connector, or formed at various other angles.

An interior conductor retainer 412 may be configured to receive portions of the conductors and secure them within the connecting body 410. The interior conductor retainer 412 may be configured to be retained within a passage of the connecting body 410.

A two-part connecting ring 414, which may include a conical cross section 416, may be used to securely clamp around an end 415 of the connecting body 410. As shown, the connecting ring 414 may include plated-through-holes 418, thereby providing a path for shield current to flow. Alternatively, the connecting ring 414 may be a single, contiguous piece, or formed from more than two pieces.

The backshell 404 may also include a connecting nut 420 having a threaded end 422 that is configured to secure to the end 415 of the connecting body 410. The connecting nut 420 also includes a cable-connecting interface 423 that is opposite from the threaded end 422. The cable-connecting interface 423 includes an outer surface 424 that is configured to receive an inner surface of the braided shield 408. As explained above, multiple plated through-holes 426 may be formed through the cable-connecting interface 423. A shield-termination band 430 may be used to securely clamp an end 432 of the braided shield 408 to the cable connecting interface 423.

Additionally, or alternatively, through-holes 426 may be formed through the connecting nut 420 at various other portions. For example, through-holes 426 may be formed through a threaded area 428 of the connecting nut 420 that is not configured to be positioned underneath the braided shield 408.

The backshell 404 may include and/or contain conducting members placed in a manner to be connected to outside and/or inside surface(s) through one or more through-holes 426. The plated surface inside of a through-hole 26 may be in contact with the edge of a conducting member. The conducting member may contact the plated surface of connecting body 410, and/or another conducting member 427 within the connecting body 410. The conducting member may be linear and singular or multiple or planar taking the shape of the connecting body 410. Additionally, a conducting member may be located along the surface of the component bodies or embedded therein. Each conducting member may be solid, mesh, perforated, or weaved, for example.

The through-holes 426 that are configured to be positioned underneath the braided shield 408, or which are otherwise positioned underneath or within other portions of the connector assembly 400, may generally include a plated interior surface that surrounds an open passage. Optionally, the through-holes 426 may be plugged with plating material. For example, any portion of the connector assembly 400 may include through-holes that provide a shield current path from an outer surface to an inner surface. If the through-holes are exposed to an outside environment, the through-holes may be plugged with conductive material, such as plating material or solder, in order to contain or block electro-magnetic interference (EMI) from flowing in or out through the through-holes. As one example, an entire surface of the backshell 404 may include through-holes. The through-holes may be sized and shaped so that when the dielectric material of the backshell 404 is covered in plating material, the plating material passes into and plugs the through-holes.

Figure 5:
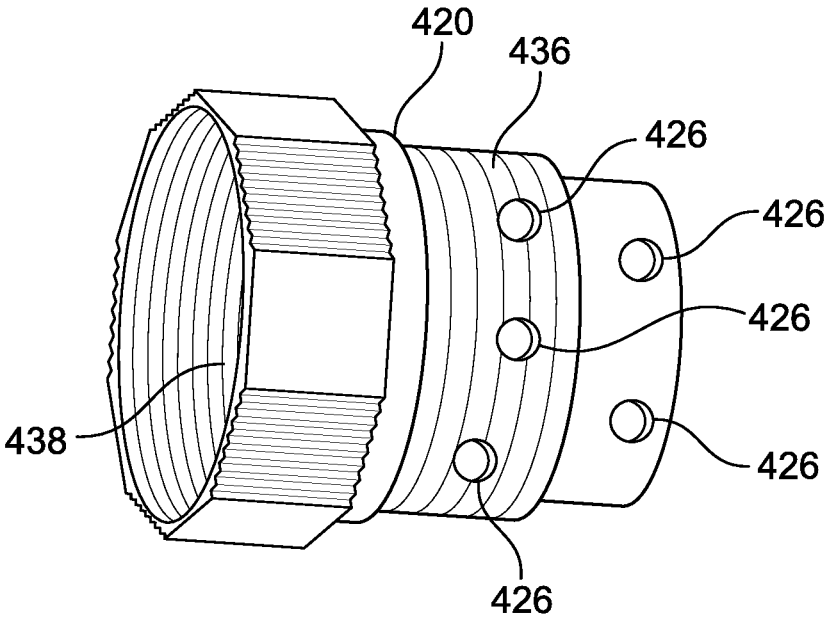
FIG. 5 illustrates a perspective view of a connecting nut, according to an embodiment of the present disclosure.

FIG. 5 illustrates a perspective view of the connecting nut 420. As shown in FIG. 5, plated through-holes 426 may be formed through various portions of the connecting nut 420, in order to provide a conductive path from an outer surface 436 to an inner surface 438.

Figure 6:
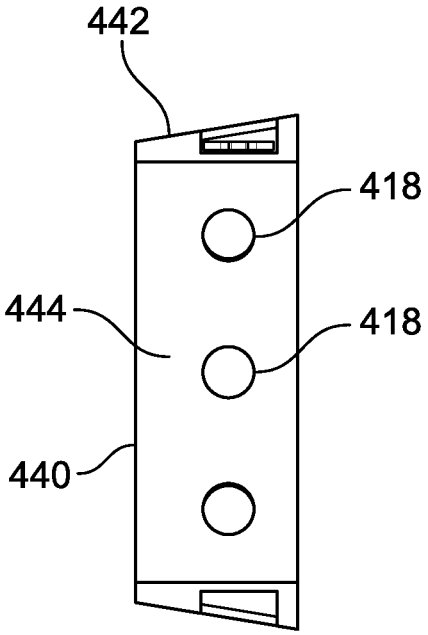
FIG. 6 illustrates a perspective view of a connecting ring half, according to an embodiment of the present disclosure.

FIG. 6 illustrates a perspective view of a connecting ring half 440, according to an embodiment of the present disclosure. Two connecting ring halves 440 may be secured together to form a clamping interface. As shown, the plated through-holes 418 may be formed through one or both connecting ring halves 440 in order to provide a conductive path from an outer surface 442 to an inner surface 444.

Figure 7:
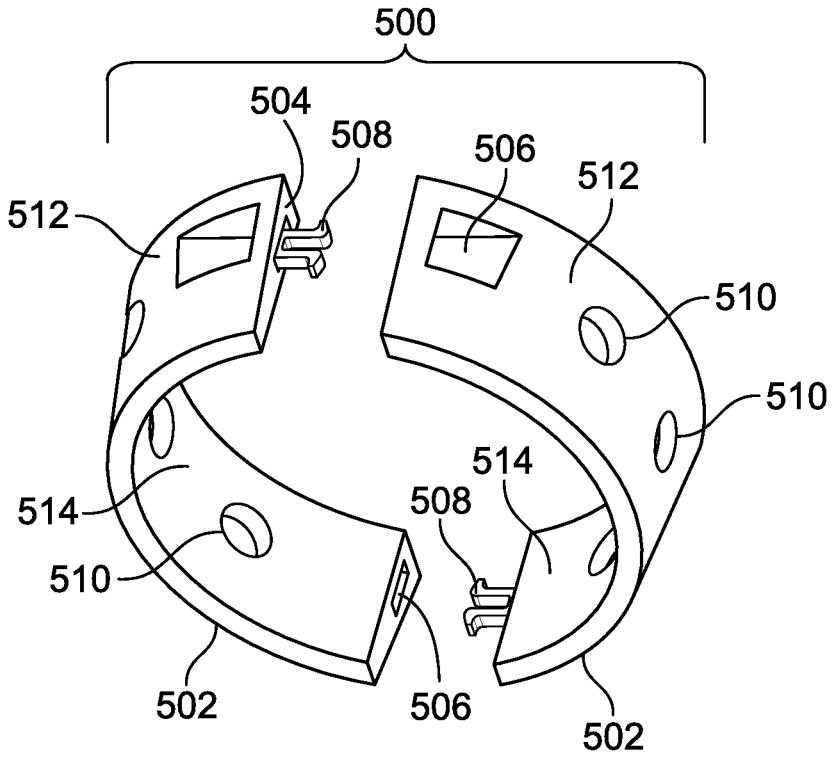
FIG. 7 illustrates a perspective view of a connecting ring in a disconnected state, according to an embodiment of the present disclosure.

FIG. 7 illustrates a perspective view of a connecting ring 500 in a disconnected state, according to an embodiment of the present disclosure. The connecting ring 500 includes opposed connecting ring halves 502. Each connecting ring half 502 may include a conical cross-section 504. One end of each connecting ring half 502 may include a slot 506 that is configured to snapably and securely receive a snap tab 508 formed at an opposite end of the other connecting ring half 502. The connecting ring 500 may be formed of a dielectric material and covered in plating material. Plated through-holes 510 are formed through the connecting ring 500 and provide a shield current path from an outer circumferential surface 512 to an inner circumferential surface 514.

Figure 8:
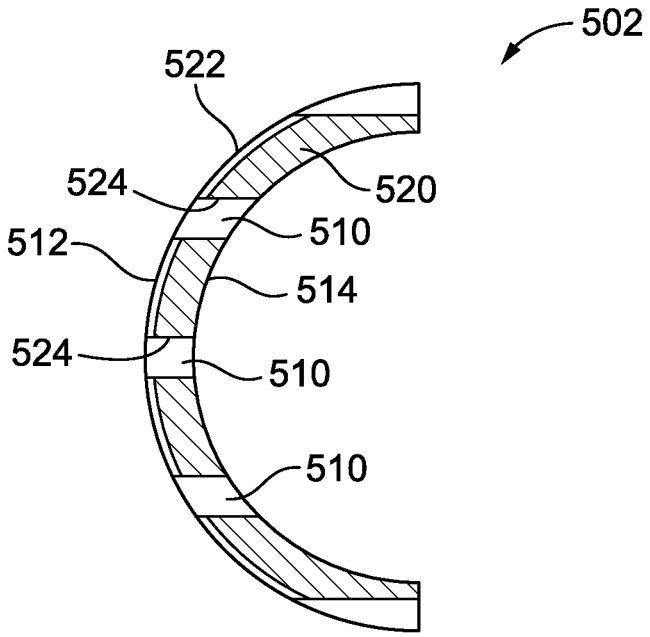
FIG. 8 illustrates an axial cross-sectional view of a connecting ring half, according to an embodiment of the present disclosure.

FIG. 8 illustrates an axial cross-sectional view of a connecting ring half 502, according to an embodiment of the present disclosure. As noted above, an interior core 520 of each connecting ring half 502 may be formed of a dielectric material. The interior core 520 may be covered and surrounded with conductive material 522, such as plating material. Further, each through-hole 510 defines an inner surface that is covered with plating material 524.

Optionally, only the outer circumferential surface 512 of the connecting ring half 502 may be covered in conductive material 522, while the inner circumferential surface 514 may be exposed dielectric material. The inner circumferential surface 514 may be clamped around a conductive surface of another portion of a connector assembly, such as a connecting nut of a backshell. As such, shield current may pass from the outer circumferential surface 512 and through the plated through-holes 510 and onto the conductive surface of the other portion of the connector assembly, and/or in the opposite direction from the conductive surface to the outer circumferential surface 512.

Figure 9:
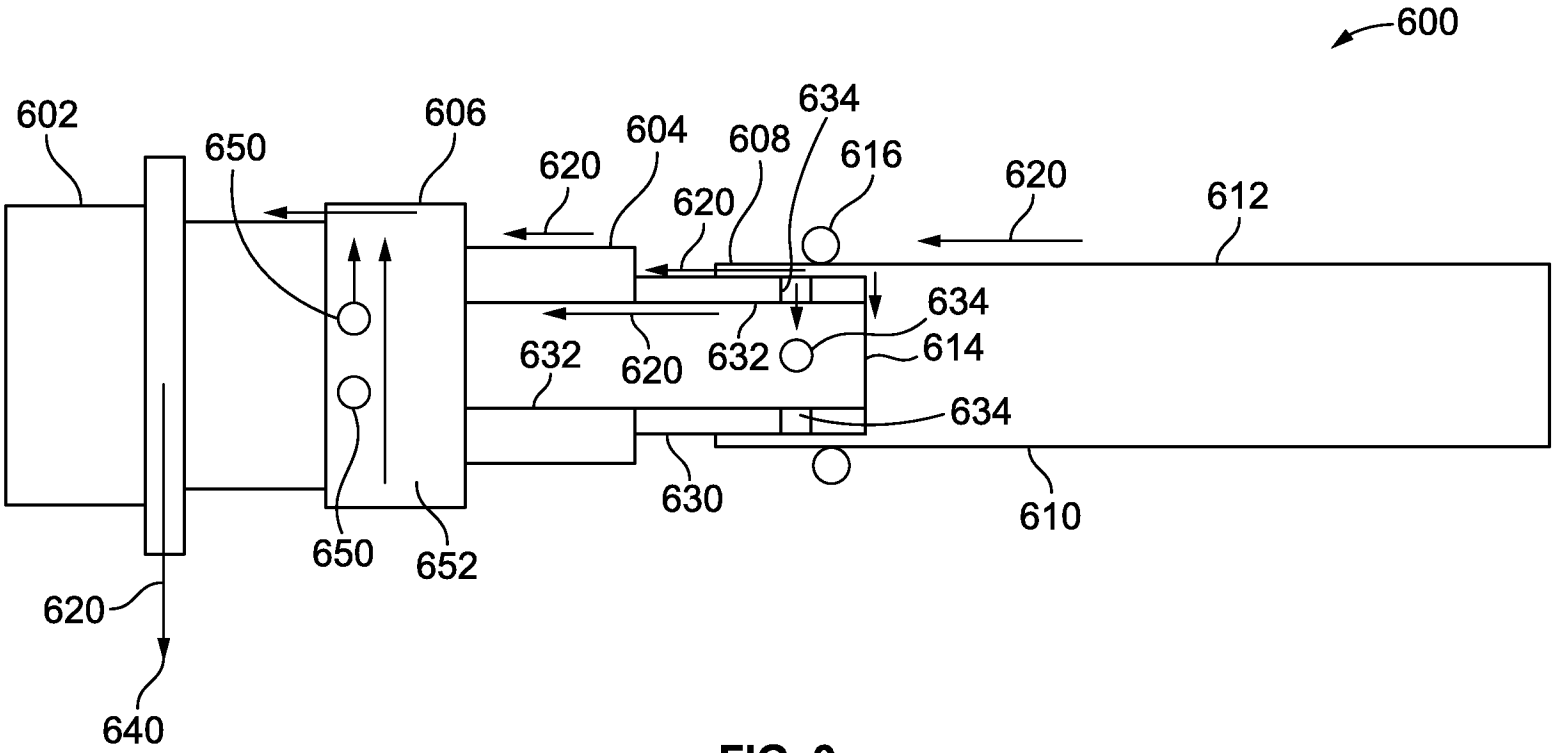
FIG. 9 illustrates a simplified transverse cross-sectional view of a connector assembly, according to an embodiment of the present disclosure.

FIG. 9 illustrates a simplified transverse cross-sectional view of a connector assembly 600, according to an embodiment of the present disclosure. The connector assembly 600 includes a housing or hood 602 that connects to a backshell 604 through a connecting ring 606 or adapter. An end 608 of a cable 610 having a braided shield 612 is secured to over an end 614, such as a cable-connecting interface, of the backshell 604 that is opposite from the connecting ring 606. A shield-termination band 616 may be used to securely clamp the end 608 of the braided shield 612 to the end 614.

As shown, shield current 620 flows over the braided shield 612 and passes into and/or onto the end 614 of the backshell 604. The shield current 620 may pass over an outer surface 630 of the backshell 604 and to ground 640 over an outer surface of the housing 602.

Additionally, the shield current 620 may pass from the outer surface 630 into an inner surface 632 of the backshell 604 through plated through-holes 634. The shield current 620 may pass over the inner surface 632 and to the housing 602, and ultimately to ground 640. As shown, the connecting ring 606 may also include plated through-holes 650 that allow shield current that is on or within the backshell 604 underneath the connecting ring 606 to pass through the plated through-holes 605 onto an outer surface 652 of the connecting ring 606, and onto the housing 602, from where the shield current 620 then passes to ground 640.

The connecting ring 606 may be a two part connecting ring, such as described with respect to FIGS. 6-8. Alternatively, the connecting ring 606 may be a single contiguous, non-separable piece. Further, the connecting ring 606 may be an adapter, as described with respect to FIG. 3.

More or less through-holes than shown may be utilized. The through-holes may be sized, shaped, and located as any of the through-holes described above. For example, exposed surfaces of the backshell 604 may include through-holes that are plugged with plating or otherwise conductive material.

Referring to FIGS. 1-9, embodiments of the present disclosure provide connector assemblies having through-holes formed through portions thereof in order to provide multiple redundant conductive paths for shield current to pass. Embodiments of the present disclosure provide connector assemblies that maintain shielding effectiveness even if outer surfaces or edges of backshells become worn or damaged, as the shield current may pass from surfaces of the backshells through the through-holes and ultimately to ground.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing that retains one or more contacts;

a cable having a shield that surrounds one or more conductors that electrically connect to the one or more contacts; and a backshell that secures the housing to the cable, wherein the backshell includes:

at least one wall having a backshell outer surface and a backshell inner surface; and one or more through-holes formed through the at least one wall, wherein each of the one or more through-holes forms a current path between the backshell outer surface and the backshell inner surface;

wherein a primary current path spans between the shield and the housing via the backshell outer surface, wherein the current path provides a secondary current path for shield current to pass when the primary current path is restricted;

wherein the one or more through-holes have interior surfaces covered with plating material.

2. The connector assembly of claim 1, wherein the one or more through-holes are configured to allow shield current from the shield to pass from the backshell outer surface to the backshell inner surface.

3. The connector assembly of claim 1, wherein the backshell further includes a cable connecting interface configured to be covered by at least a portion of the shield, wherein the one or more through-holes are formed through the cable-connecting interface.

4. The connector assembly of claim 1, wherein the one or more through-holes are plugged with plating material.

5. The connector assembly of claim 1, wherein the backshell further includes a dielectric core covered with a conductive material.

6. The connector assembly of claim 1, further comprising at least one connecting ring that securely clamps a portion of the backshell to a portion of the housing.

7. The connector assembly of claim 6, wherein the connecting ring comprises one or more ring through-holes.

8. The connector assembly of claim 6, wherein the connecting ring includes a dielectric core having at least a portion covered with a conductive material.

9. A backshell that is configured to secure a housing that retains one or more contacts to a cable having a shield that surrounds one or more conductors that are configured to electrically connect to the one or more contacts, the backshell comprising:

at least one wall having a backshell outer surface and a backshell inner surface; and one or more through-holes formed through the at least one wall, wherein each of the one or more through-holes forms a current path between the backshell outer surface and the backshell inner surface;

wherein the one or more through-holes have interior surfaces covered with plating material.

10. The backshell of claim 9, wherein the one or more through-holes are configured to allow shield current from the shield to pass from the backshell outer surface to the backshell inner surface.

11. The backshell of claim 9, further including a cable connecting interface configured to be covered by at least a portion of the shield, wherein the one or more through-holes are formed through the cable-connecting interface.

12. The backshell of claim 9, wherein the one or more through-holes are plugged with plating material.

13. The backshell of claim 9, wherein the backshell further includes a dielectric core covered with a conductive material.

14. A connector assembly comprising:

a housing that retains one or more contacts;

a cable having a shield that surrounds one or more conductors that electrically connect to the one or more contacts; and a backshell that secures the housing to the cable, wherein the backshell includes:

a dielectric core covered with conductive material;

at least one wall having a backshell outer surface and a backshell inner surface, wherein a primary current path spans between the shield and the housing via the backshell outer surface; and a plurality of plated through-holes formed through the at least one wall, wherein each of the plurality of plated through-holes forms a secondary current path between the backshell outer surface and the backshell inner surface, wherein the plurality of plated through-holes are configured to allow shield current from the shield to pass from the backshell outer surface to the backshell inner surface.

15. The connector assembly of claim 14, wherein the backshell further includes a cable connecting interface configured to be covered by at least a portion of the shield, wherein the plurality of plated through-holes are formed through the cable-connecting interface.

16. The connector assembly of claim 14, wherein at least one of the plurality of plated through-holes has an interior surface covered with plating material.

17. The connector assembly of claim 14, wherein at least one of the plurality of plated through-holes is plugged with plating material.

* * * * *